US011774147B2

(12) United States Patent
Xu et al.

(10) Patent No.: US 11,774,147 B2
(45) Date of Patent: Oct. 3, 2023

(54) CRYOCOOLER

(71) Applicant: SUMITOMO HEAVY INDUSTRIES, LTD., Tokyo (JP)

(72) Inventors: Mingyao Xu, Nishitokyo (JP); Qian Bao, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 350 days.

(21) Appl. No.: 17/185,996

(22) Filed: Feb. 26, 2021

(65) Prior Publication Data

US 2021/0180834 A1 Jun. 17, 2021

Related U.S. Application Data

(63) Continuation of application No. PCT/JP2019/031007, filed on Aug. 6, 2019.

(30) Foreign Application Priority Data

Sep. 7, 2018 (JP) ..... 2018-167725

(51) Int. Cl.
*F25B 9/14* (2006.01)

(52) U.S. Cl.
CPC ..... *F25B 9/14* (2013.01)

(58) Field of Classification Search
CPC ..... F25B 9/14
USPC ..... 62/6
See application file for complete search history.

(56) References Cited

U.S. PATENT DOCUMENTS

| | | | | |
|---|---|---|---|---|
| 6,256,997 | B1 | 7/2001 | Longsworth | |
| 10,634,393 | B2 | 4/2020 | Longsworth | |
| 2018/0023849 | A1* | 1/2018 | Longsworth | F25B 9/14 62/6 |
| 2019/0277542 | A1 | 9/2019 | Xu et al. | |

FOREIGN PATENT DOCUMENTS

| | | | | |
|---|---|---|---|---|
| EP | 0119846 | A2 * | 9/1984 | F25B 9/14 |
| JP | H0244662 | U | 3/1990 | |
| JP | H02197765 | A | 8/1990 | |
| JP | H08303889 | A | 11/1996 | |

(Continued)

OTHER PUBLICATIONS

Carolo, Pneumatically Controlled Split Cycle Cooler, 1984, Full Document (Year: 1984).*

(Continued)

*Primary Examiner* — Nael N Babaa
(74) *Attorney, Agent, or Firm* — HEA LAW PLLC

(57) ABSTRACT

There is provided a cryocooler including a cylinder, a displacer disposed inside the cylinder and driven to reciprocate by a gas pressure, a collar rigidly connected to the displacer to reciprocate together with the displacer, a collar chamber divided into an upper section and a lower section by the collar, a second seal portion provided between the displacer and the cylinder to seal the lower section, a lower bumper provided in the lower section to mitigate interference between the displacer and the cylinder when the displacer is located at a bottom dead center, and a communication passage formed in the collar or in the collar chamber to ensure communication between the upper section and the lower section when the displacer is located at a bottom dead center.

9 Claims, 3 Drawing Sheets

(56) References Cited

FOREIGN PATENT DOCUMENTS

| | | | |
|---|---|---|---|
| JP | 2003523496 | A | 8/2003 |
| JP | 2018036042 | A | 3/2018 |
| WO | 2018101271 | A1 | 6/2018 |

OTHER PUBLICATIONS

International Search Report of Oct. 8, 2019 for PCT/JP2019/031007.
International Preliminary Report on Patentability of Mar. 18, 2021 for PCT/JP2019/031007.

* cited by examiner

CRYOCOOLER

RELATED APPLICATIONS

The contents of Japanese Patent Application No. 2018-167725, and of International Patent Application No. PCT/JP2019/031007, on the basis of each of which priority benefits are claimed in an accompanying application data sheet, are in their entirety incorporated herein by reference.

BACKGROUND

Technical Field

Certain embodiments of the present invention relate to a cryocooler.

Description of Related Art

A Gifford-McMahon (GM) cryocooler as one representative example of cryocoolers is roughly classified into two types such as a motor-driven type and a gas-driven type, depending on a drive source of a displacer. In the motor-driven type, the displacer is mechanically connected to a motor, and is driven by the motor. In the gas-driven type, the displacer is driven by a gas pressure.

SUMMARY

According to an embodiment of the present invention, there is provided a cryocooler including a cylinder, a displacer disposed inside the cylinder and driven to reciprocate by a gas pressure, a collar rigidly connected to the displacer to reciprocate together with the displacer, a collar chamber divided into an upper section and a lower section by the collar, a second seal portion provided between the displacer and the cylinder to seal the lower section, a lower bumper provided in the lower section to mitigate interference between the displacer and the cylinder when the displacer is located at a bottom dead center, and a communication passage formed in the collar or in the collar chamber to ensure communication between the upper section and the lower section when the displacer is located at a bottom dead center.

DETAILED DESCRIPTION

Figure 1:
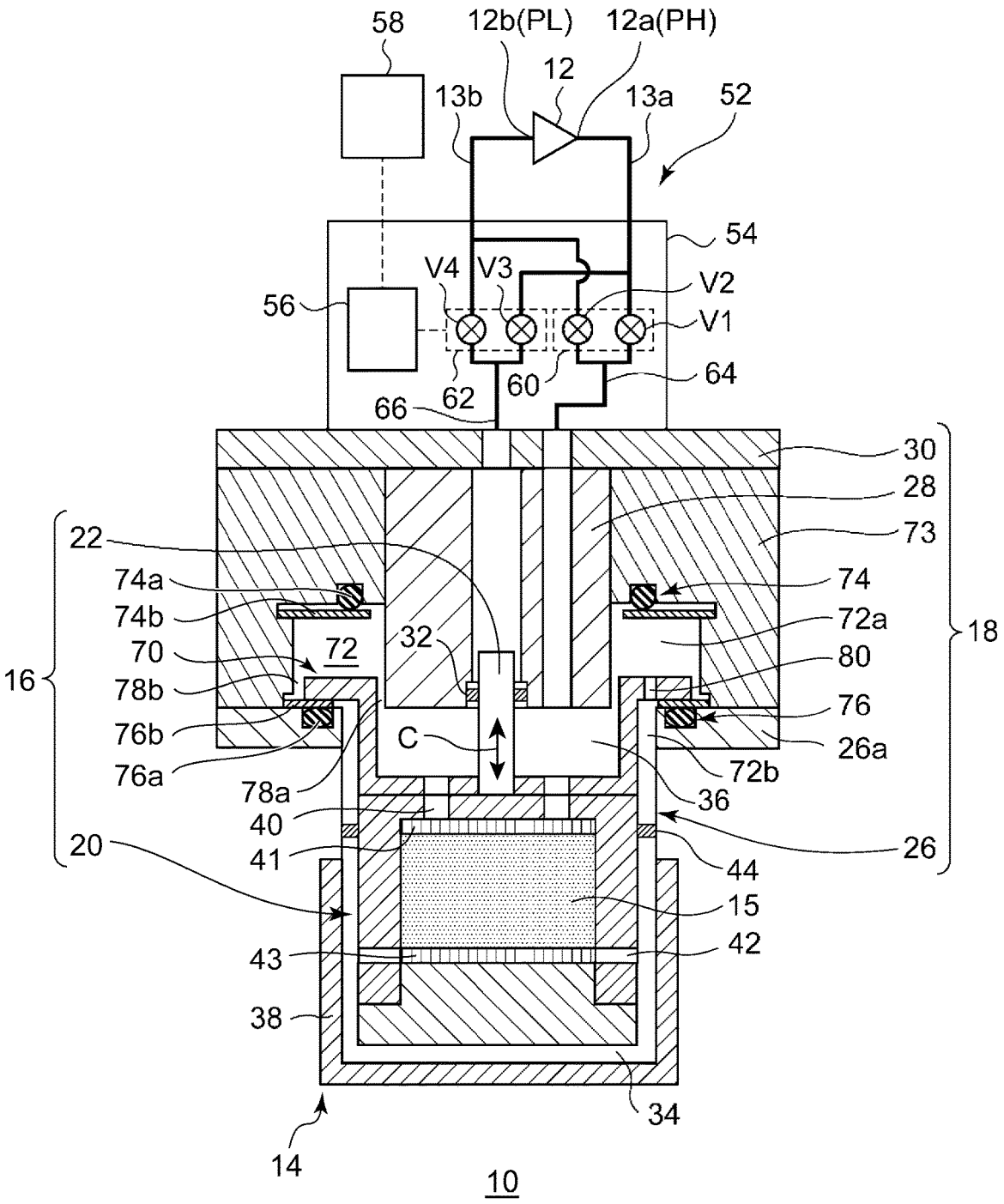
FIG. 1 is a view schematically illustrating a cryocooler according to one embodiment.

The present inventors have recognized the following facts, as a result of intensive research on a gas-driven cryocooler. In the gas-driven cryocooler in the related art, a displacer moves due to a gas pressure until the displacer interferes (for example, collides) with a cylinder end portion. The interference may cause vibration and noise. A design called a "collar bumper" may be adopted to prevent the interference between the displacer and the cylinder end portion and to reduce the vibration and the noise. However, in the gas-driven cryocooler adopting a collar bumper type, when the displacer reaches a bottom dead center, a low pressure sealed region is formed on one side of a collar. Consequently, due to a differential pressure from a high pressure region on the other side of the collar, a movement of the displacer toward a top dead center may be hindered.

It is desirable to facilitate the movement of the displacer from the bottom dead center toward the top dead center in the gas-driven cryocooler adopting the collar bumper type.

Any desired combinations of the above-described components or those in which components or expressions according to the present invention are substituted with each other in methods, devices, and systems may be effectively adopted as an aspect of the present invention.

According to the present invention, it is possible to facilitate the movement of the displacer from the bottom dead center to the top dead center in the gas-driven cryocooler adopting the collar bumper type.

Hereinafter, embodiments according to the present invention will be described in detail with reference to the drawings. The same reference numerals will be assigned to the same or equivalent components, members, and processes in the description and the drawings, and repeated description will be appropriately omitted. Scales or shapes of respectively illustrated elements are set for convenience in order to facilitate the description, and are not to be interpreted in a limited manner unless otherwise specified. The embodiments described below are merely examples, and do not limit the scope of the present invention at all. All features or combinations thereof described in the embodiments are not necessarily essential to the invention.

Figure 2:
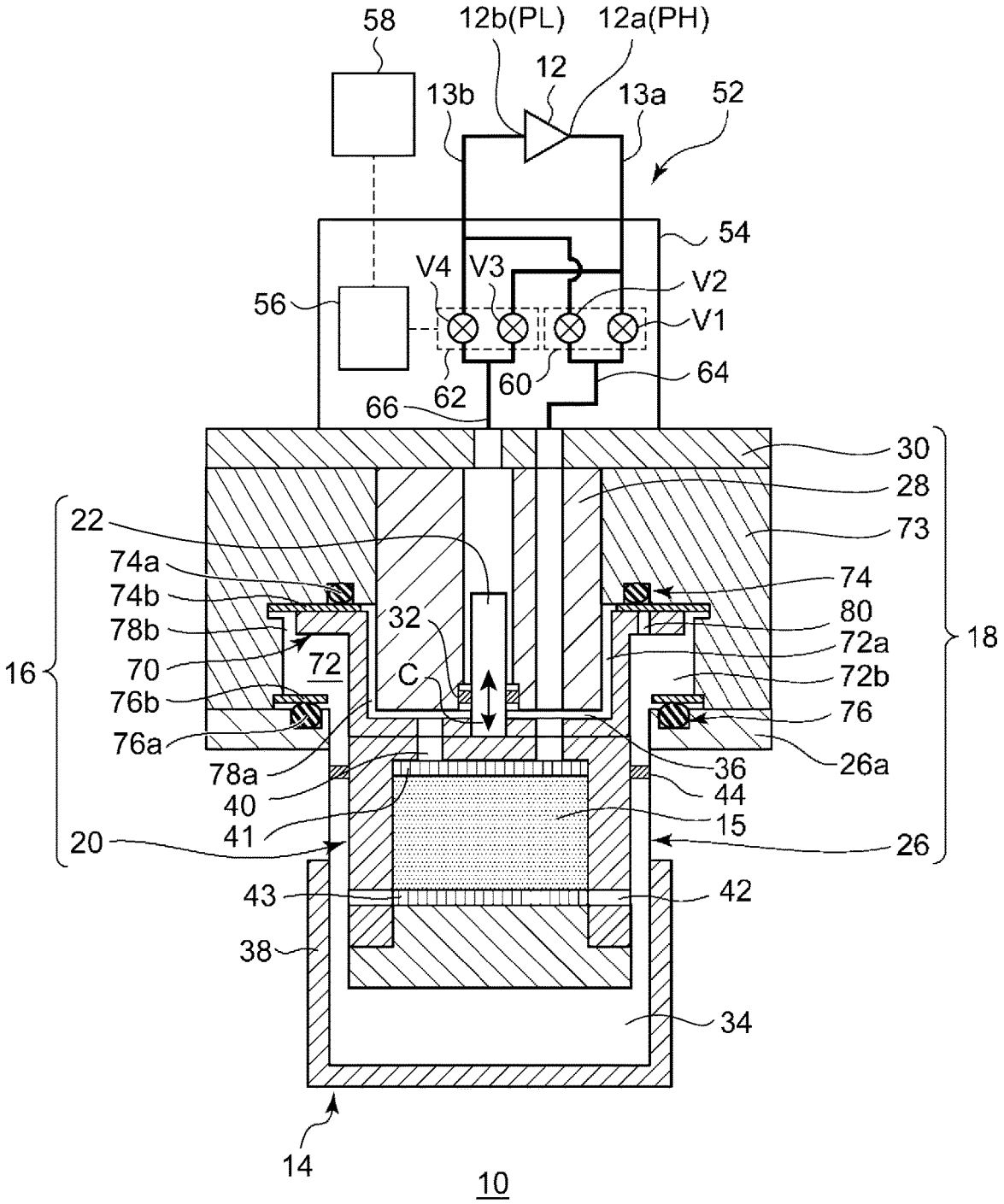
FIG. 2 is a view schematically illustrating the cryocooler according to the embodiment.

FIGS. 1 and 2 are views schematically illustrating a cryocooler 10 according to one embodiment. For example, the cryocooler 10 is a gas-driven GM cryocooler.

The cryocooler 10 includes a compressor 12 which compresses working gas (for example, helium gas) and a cold head 14 which cools the working gas through adiabatic expansion. The compressor 12 has a compressor discharge port 12*a* and a compressor suction port 12*b*. The compressor discharge port 12*a* and the compressor suction port 12*b* respectively function as a high pressure source and a low pressure source of the cryocooler 10. The cold head 14 is also called an expander.

As will be described in detail later, the compressor 12 supplies high pressure (PH) working gas from the compressor discharge port 12*a* to the cold head 14. The cold head 14 includes a regenerator 15 which pre-cools the working gas. The precooled working gas is further cooled through expansion inside the cold head 14. The working gas is recovered to the compressor suction port 12*b* through the regenerator 15. The working gas cools the regenerator 15 when the working gas passes through the regenerator 15. The compressor 12 compresses the recovered low pressure (PL) working gas, and supplies the working gas to the cold head 14 again.

The illustrated cold head 14 is a single stage type. However, the cold head 14 may be a multi-stage type.

The cold head 14 includes an axially movable body 16 serving as a free piston driven by a gas pressure, and a cold head housing 18 configured to be hermetic and accommodating the axially movable body 16. The cold head housing 18 supports the axially movable body 16 to be capable of reciprocating in an axial direction, and is configured to serve as a pressure vessel for the working gas. Unlike a motor-driven type GM cryocooler, the cold head 14 does not have a motor for driving the axially movable body 16 and a connecting mechanism (for example, a scotch yoke mechanism).

The axially movable body 16 includes a displacer 20 capable of reciprocating in the axial direction (upward-downward direction in FIG. 1, indicated by an arrow C), and a drive piston 22 coaxially connected to the displacer 20 to drive the displacer 20 in the axial direction. The drive piston 22 is rigidly connected to the displacer 20 so that the displacer 20 reciprocates in the axial direction integrally with the drive piston 22. The drive piston 22 has a dimension smaller than that of the displacer 20. An axial length of the drive piston 22 is shorter than that of the displacer 20, and a diameter of the drive piston 22 is smaller than that of the displacer 20.

The cold head housing 18 includes a displacer cylinder 26 which accommodates the displacer 20, and a piston cylinder 28 which accommodates the drive piston 22. The piston cylinder 28 is located coaxially with and adjacent to the displacer cylinder 26 in the axial direction. Although details will be described later, a drive part of the cold head 14 which is the gas-driven type is configured to include the drive piston 22 and the piston cylinder 28. A volume of the piston cylinder 28 is smaller than that of the displacer cylinder 26. The axial length of the piston cylinder 28 is shorter than that of the displacer cylinder 26, and the diameter of the piston cylinder 28 is smaller than that of the displacer cylinder 26.

Axial reciprocation of the displacer 20 is guided by the displacer cylinder 26. In general, the displacer 20 and the displacer cylinder 26 are cylindrical members which respectively extend in the axial direction, and an inner diameter of the displacer cylinder 26 coincides with or slightly larger than an outer diameter of the displacer 20. Similarly, the axial reciprocation of the drive piston 22 is guided by the piston cylinder 28. In general, the drive piston 22 and the piston cylinder 28 are cylindrical members which respectively extend in the axial direction, and the inner diameter of the piston cylinder 28 coincides with or slightly larger than the outer diameter of the drive piston 22.

The displacer 20 and the drive piston 22 are rigidly connected to each other. Accordingly, an axial stroke of the drive piston 22 is equal to an axial stroke of the displacer 20, and both of these integrally move over all strokes. A position of the drive piston 22 with respect to the displacer 20 is unchanged during the axial reciprocation of the axially movable body 16.

A first seal portion 32 is provided between the drive piston 22 and the piston cylinder 28. The first seal portion 32 is mounted on one of the drive piston 22 and the piston cylinder 28, and slides on the other of the drive piston 22 and the piston cylinder 28. For example, the first seal portion 32 is formed of a sealing member such as a slipper seal or an O-ring. The piston cylinder 28 is configured to be hermetic with respect to the displacer cylinder 26 by the first seal portion 32. Since the first seal portion 32 is provided, there is no direct gas circulation between the piston cylinder 28 and the displacer cylinder 26. An internal pressure of the piston cylinder 28 and an internal pressure of the displacer cylinder 26 can have different magnitudes.

The displacer cylinder 26 is divided into an expansion chamber 34 and a room temperature chamber 36 by the displacer 20. The displacer 20 forms the expansion chamber 34 with the displacer cylinder 26 in one end in the axial direction, and forms the room temperature chamber 36 with the displacer cylinder 26 in the other end in the axial direction. The room temperature chamber 36 can also be called a compression chamber. In addition, the cold head 14 is provided with a cooling stage 38 fixed to the displacer cylinder 26 so as to wrap the expansion chamber 34.

The regenerator 15 is incorporated in the displacer 20. An upper lid portion of the displacer 20 has an inlet flow path 40 through which the regenerator 15 communicates with the room temperature chamber 36. In addition, a cylinder portion of the displacer 20 has an outlet flow path 42 through which the regenerator 15 communicates with the expansion chamber 34. Alternatively, the outlet flow path 42 may be provided in a lower lid portion of the displacer 20. In addition, the regenerator 15 includes an inlet retainer 41 inscribed in the upper lid portion and an outlet retainer 43 inscribed in the lower lid portion. A regenerator material may be a copper wire mesh, for example. The retainer may be a wire mesh which is coarser than the regenerator material.

A second seal portion 44 is provided between the displacer 20 and the displacer cylinder 26. For example, the second seal portion 44 is a slipper seal, and is mounted on the cylinder portion or the upper lid portion of the displacer 20. A clearance between the displacer 20 and the displacer cylinder 26 is sealed by the second seal portion 44. Accordingly, there is no direct gas circulation (that is, a gas flow bypassing the regenerator 15) between the room temperature chamber 36 and the expansion chamber 34.

The working gas flows into the regenerator 15 from the room temperature chamber 36 through the inlet flow path 40. More precisely, the working gas flows into the regenerator 15 from the inlet flow path 40 through the inlet retainer 41. The working gas flows into the expansion chamber 34 from the regenerator 15 by way of the outlet retainer 43 and the outlet flow path 42. When the working gas returns to the room temperature chamber 36 from the expansion chamber 34, the working gas passes a reverse path thereof. That is, the working gas returns to the room temperature chamber 36 from the expansion chamber 34 through the outlet flow path 42, the regenerator 15, and the inlet flow path 40. The working gas trying to flow into the clearance after bypassing the regenerator 15 is blocked by the second seal portion 44.

The cold head 14 is installed in an illustrated direction at a job site where the cold head 14 is used. That is, the cold head 14 is vertically installed by disposing the displacer cylinder 26 below in the vertical direction and disposing the piston cylinder 28 above in the vertical direction, respectively. In this way, the cryocooler 10 has highest cooling capacity when the cooling stage 38 is installed by adopting a downward facing posture in the vertical direction. However, disposition of the cryocooler 10 is not limited thereto. Conversely, the cold head 14 may be installed by adopting a posture in which the cooling stage 38 faces upward in the vertical direction. Alternatively, the cold head 14 may be installed sideways or in any other direction. The cold head 14 can perform a cooling operation even when the cold head 14 is installed by adopting any posture.

An end of the reciprocating stroke of the displacer 20 on the expansion chamber 34 side will be referred to as a bottom dead center of the displacer 20, and an end of the reciprocating stroke of the displacer 20 on the room temperature chamber 36 side will be referred to as a top dead center of the displacer 20. A movement of the displacer 20 toward the top dead center may be referred to as an upward movement, and a movement of the displacer 20 toward the bottom dead center may be referred to as a downward movement. However, these terms do not limit the posture of the cold head 14.

When the displacer 20 moves in the axial direction, the expansion chamber 34 and the room temperature chamber 36 complementarily increase and decrease respective volumes. That is, when the displacer 20 moves downward, the expansion chamber 34 is narrowed, and the room temperature chamber 36 is widened. And vice versa. Therefore, when the displacer 20 is located at the bottom dead center, the volume of the expansion chamber 34 is minimized (volume of the room temperature chamber 36 is maximized). When the displacer 20 is located at the top dead center, the volume of the expansion chamber 34 is maximized (the volume of the room temperature chamber 36 is minimized).

Furthermore, the cryocooler 10 includes a working gas circuit 52 which connects the compressor 12 to the cold head 14. The working gas circuit 52 is configured to generate a pressure difference between the piston cylinder 28 and the displacer cylinder 26 (that is, the expansion chamber 34 and/or the room temperature chamber 36). The pressure difference causes the axially movable body 16 to move in the axial direction. When the pressure of the displacer cylinder 26 is lower than that of the piston cylinder 28, the drive piston 22 moves downward, and consequently, the displacer 20 also moves downward. Conversely, when the pressure of the displacer cylinder 26 is higher than that of the piston cylinder 28, the drive piston 22 moves upward, and consequently, the displacer 20 also moves upward.

The working gas circuit 52 includes a valve portion 54. The valve portion 54 may be disposed adjacent to the piston cylinder 28 to be integrated with the cold head housing 18, and may be connected to the compressor 12 by using a pipe. The valve portion 54 may be disposed outside the cold head housing 18, and may be connected to each of the compressor 12 and the cold head 14 by using a pipe.

The valve portion 54 includes an expansion chamber pressure switching valve (hereinafter, also referred to as a main pressure switching valve) 60 and a drive chamber pressure switching valve (hereinafter, also referred to as an auxiliary pressure switching valve) 62. The main pressure switching valve 60 has a main intake on-off valve V1 and a main exhaust on-off valve V2. The auxiliary pressure switching valve 62 has an auxiliary intake on-off valve V3 and an auxiliary exhaust on-off valve V4.

The working gas circuit 52 includes a high pressure line 13*a* and a low pressure line 13*b* which connect the compressor 12 to the valve portion 54. The high pressure line 13*a* extends from the compressor discharge port 12*a*, branches in an intermediate portion, and is connected to the main intake on-off valve V1 and the auxiliary intake on-off valve V3. The low pressure line 13*b* extends from the compressor suction port 12*b*, branches in an intermediate portion, and is connected to the main exhaust on-off valve V2 and the auxiliary exhaust on-off valve V4.

In addition, the working gas circuit 52 includes a main communication passage 64 and an auxiliary communication passage 66 which connect the cold head 14 to the valve portion 54. The main communication passage 64 connects the displacer cylinder 26 to the main pressure switching valve 60. The main communication passage 64 extends from the room temperature chamber 36, branches in an intermediate portion, and is connected to the main intake on-off valve V1 and the main exhaust on-off valve V2. The auxiliary communication passage 66 connects the piston cylinder 28 to the auxiliary pressure switching valve 62. The auxiliary communication passage 66 extends from the piston cylinder 28, branches in an intermediate portion, and is connected to the auxiliary intake on-off valve V3 and the auxiliary exhaust on-off valve V4.

The main pressure switching valve 60 is configured so that the compressor discharge port 12*a* or the compressor suction port 12*b* selectively communicates with the room temperature chamber 36 of the displacer cylinder 26. In the main pressure switching valve 60, the main intake on-off valve V1 and the main exhaust on-off valve V2 are respectively and exclusively opened. That is, the main intake on-off valve V1 and the main exhaust on-off valve V2 are inhibited from being opened at the same time. The main intake on-off valve V1 and the main exhaust on-off valve V2 may be temporarily closed together.

When the main intake on-off valve V1 is open, the main exhaust on-off valve V2 is closed. The working gas flows from the compressor discharge port 12*a* to the displacer cylinder 26 through the high pressure line 13*a* and the main communication passage 64. As described above, the working gas flows from the room temperature chamber 36 to the expansion chamber 34 through the regenerator 15. In this way, the working gas having a high pressure PH is supplied from the compressor 12 to the expansion chamber 34, and the expansion chamber 34 is pressurized. Conversely, when the main intake on-off valve V1 is closed, the supply of the working gas from the compressor 12 to the expansion chamber 34 is stopped.

On the other hand, when the main exhaust on-off valve V2 is open, the main intake on-off valve V1 is closed. First, the working gas having the high pressure PH is expanded and decompressed in the expansion chamber 34. The working gas flows from the expansion chamber 34 to the room temperature chamber 36 through the regenerator 15. The working gas flows from the displacer cylinder 26 to the compressor suction port 12*b* through the main communication passage 64 and the low pressure line 13*b*. In this way, the working gas having a low pressure PL is recovered from the cold head 14 to the compressor 12. When the main exhaust on-off valve V2 is closed, the recovery of the working gas from the expansion chamber 34 to the compressor 12 is stopped.

The auxiliary pressure switching valve 62 is configured so that the compressor discharge port 12*a* or the compressor suction port 12*b* selectively communicates with the piston cylinder 28. The auxiliary pressure switching valve 62 is configured so that the auxiliary intake on-off valve V3 and the auxiliary exhaust on-off valve V4 are respectively and exclusively opened. That is, the auxiliary intake on-off valve V3 and the auxiliary exhaust on-off valve V4 are inhibited from being opened at the same time. The auxiliary intake on-off valve V3 and the auxiliary exhaust on-off valve V4 may be temporarily closed together.

When the auxiliary exhaust on-off valve V4 is open, the auxiliary intake on-off valve V3 is closed. The working gas flows from the compressor discharge port 12*a* to the piston cylinder 28 through the high pressure line 13*a* and the auxiliary communication passage 66. In this way, the working gas having the high pressure PH is supplied from the compressor 12 to the piston cylinder 28, and the piston cylinder 28 is pressurized. When the auxiliary intake on-off valve V3 is closed, the supply of the working gas from the compressor 12 to the piston cylinder 28 is stopped.

On the other hand, when the auxiliary exhaust on-off valve V4 is open, the auxiliary intake on-off valve V3 is closed. The working gas is recovered from the piston cylinder 28 to the compressor suction port 12*b* through the auxiliary communication passage 66 and the low pressure line 13*b*, and the piston cylinder 28 is decompressed to the low pressure PL. When the auxiliary exhaust on-off valve V4 is closed, the recovery of the working gas from the piston cylinder 28 to the compressor 12 is stopped.

In this way, the main pressure switching valve 60 generates periodic pressure fluctuations of the high pressure PH and the low pressure PL in the expansion chamber 34. In addition, the auxiliary pressure switching valve 62 generates periodic pressure fluctuations of the high pressure PH and the low pressure PL in the piston cylinder 28.

The auxiliary pressure switching valve 62 is configured to control the pressure of the piston cylinder 28 so that the drive piston 22 drives the displacer 20 to reciprocate in the axial direction. Typically, the pressure fluctuations in the piston cylinder 28 are generated in a substantially opposite phase to and in the same cycle as that of the pressure fluctuations in the expansion chamber 34. When the expansion chamber 34 has the high pressure PH, the piston cylinder 28 has the low pressure PL, and the drive piston 22 can move the displacer 20 upward. When the expansion chamber 34 has the low pressure PL, the piston cylinder 28 has the high pressure PH, and the drive piston 22 can move the displacer 20 downward.

The valve portion 54 may adopt a form of a rotary valve. A group of valves (V1 to V4) is incorporated in the valve portion 54, and the valves are synchronously driven. The valve portion 54 is configured so that the valves (V1 to V4) are properly switched therebetween by rotational sliding of a valve disc (or a valve rotor) with respect to a valve main body (or a valve stator). The group of valves (V1 to V4) is switched in the same cycle during an operation of the cryocooler 10. In this manner, four on-off valves (V1 to V4) periodically changes opened and closed states. The four on-off valves (V1 to V4) are opened and closed in respectively different phases.

The cryocooler 10 may include a rotation drive source 56 connected to the valve portion 54 to rotate the valve portion 54. The rotation drive source 56 is mechanically connected to the valve portion 54. The rotation drive source 56 is a motor, for example. However, the rotation drive source 56 is not mechanically connected to the axially movable body 16. In addition, the cryocooler 10 may include a control unit 58 that controls the valve portion 54. The control unit 58 may control the rotation drive source 56.

In a certain embodiment, the group of valves (V1 to V4) may adopt a form of a plurality of individually controllable valves. Each of the valves (V1 to V4) may be an electromagnetic on-off valve. In this case, the rotation drive source 56 is not provided, and each of the valves (V1 to V4) is electrically connected to the control unit 58. The control unit 58 may control the opening and closing of each of the valves (V1 to V4).

FIG. 1 illustrates a state where the displacer 20 is located at the bottom dead center, and FIG. 2 illustrates a state where the displacer 20 is located at the top dead center.

The cryocooler 10 adopts a collar bumper type. Accordingly, the cold head 14 includes a collar 70 and a collar chamber 72 divided into an upper section 72*a* and a lower section 72*b* by the collar 70. The collar 70 is rigidly connected to the displacer 20 to reciprocate together with the displacer 20, and forms a portion of the axially movable body 16. As will be described later, the reciprocating stroke of the collar 70 in the collar chamber 72 determines the reciprocating stroke of the displacer 20.

The displacer cylinder 26 includes a cylinder flange 26*a* that defines a cylinder upper opening. The cylinder flange 26*a* extends outward in the radial direction from an upper end of the displacer cylinder 26 in the axial direction. The cold head housing 18 includes a top plate 30 and a sleeve 73. The piston cylinder 28 and the sleeve 73 are fixed to the top plate 30, and the valve portion 54 is mounted on the top plate 30. The cylinder flange 26*a* is connected to the top plate 30 via the sleeve 73. The sleeve 73 is disposed outside the piston cylinder 28 to surround the piston cylinder 28.

The collar 70 includes a cylindrical main body 70*a* and a collar upper end 70*b*. The main body 70*a* has an outer diameter substantially the same as that of the displacer 20, and extends upward from the room temperature chamber 36 side of the displacer 20. An inner diameter of the main body 70*a* is larger than an outer diameter of the piston cylinder 28. The collar upper end 70*b* exists outside the outer diameter of the displacer 20. The collar chamber 72 is divided into an upper section 72*a* and a lower section 72*b* by the collar upper end 70*b*. The collar chamber 72 communicates with the room temperature chamber 36. When the displacer 20 reciprocates inside the displacer cylinder 26, the collar 70 reciprocates in the collar chamber 72 without rubbing against the displacer cylinder 26 and the piston cylinder 28. The collar 70 does not rub against an inner peripheral surface of the sleeve 73.

In addition, the cold head 14 includes an upper bumper 74 provided in the upper section 72*a* to mitigate interference between the displacer 20 and the displacer cylinder 26 when the displacer 20 is located at top dead center. The upper bumper 74 is installed on an upper surface of the collar chamber 72, and has an upper cushioning material 74*a* and an upper retainer 74*b*. For example, the upper bumper 74 is attached to the sleeve 73. For example, the upper cushioning material 74*a* is a resin-made annular member such as an O-ring, and is pinched between the upper surface of the collar chamber 72 and the upper retainer 74*b*. For example, the upper retainer 74*b* is formed of a resin material. The upper retainer 74*b* may not be provided.

The upper bumper 74 comes into contact with the collar 70 when the displacer 20 is located at the top dead center, and prevents the displacer 20 and the displacer cylinder 26 from colliding with each other on the room temperature chamber 36 side. The collar upper end 70*b* engages with the upper bumper 74 inside the collar chamber 72 before the displacer 20 collides with the piston cylinder 28 when the displacer 20 moves upward. In this case, the collar upper end 70*b* comes into contact with the upper retainer 74*b*, and the upper cushioning material 74*a* is compressed to absorb an impact.

The cold head 14 includes a lower bumper 76 provided in the lower section 72*b* to mitigate interference between the displacer 20 and the displacer cylinder 26 when the displacer 20 is located at the bottom dead center. The lower bumper 76 is installed on a lower surface of the collar chamber 72 and has a lower cushioning material 76*a* and a lower retainer 76*b*. For example, the lower bumper 76 is attached to the cylinder flange 26*a*. The lower bumper 76 may be attached to the sleeve 73. For example, the lower cushioning material 76*a* is a resin-made annular member such as an O-ring, and is pinched between the lower surface of the collar chamber 72 and the lower retainer 76*b*. For example, the lower retainer 76*b* is formed of a resin material. The lower retainer 76*b* may not be provided.

The lower bumper 76 comes into contact with the collar 70 when the displacer 20 is located at the bottom dead center, and prevents the displacer 20 and the displacer cylinder 26 from colliding with each other on the expansion chamber 34 side. The collar upper end 70*b* engages with the lower bumper 76 inside the collar chamber 72 before the displacer 20 collides with the displacer cylinder 26 on the expansion chamber 34 side when the displacer 20 moves downward. In this case, the collar upper end 70*b* comes into contact with the lower retainer 76*b*, and the lower cushioning material 76*a* is compressed to absorb the impact.

The upper section 72*a* communicates with the room temperature chamber 36. A first gap 78*a* is formed between the outer peripheral surface of the piston cylinder 28 and the inner peripheral surface of the collar 70, and the working gas can flow between the room temperature chamber 36 and the upper section 72*a* through the first gap 78*a*.

The lower section 72*b* communicates with the upper section 72*a*. A second gap 78*b* is formed between the inner peripheral surface of the sleeve 73 and the outer peripheral surface of the collar upper end 70*b*, and the working gas can flow between the upper section 72*a* and the lower section 72*b* through the second gap 78*b*. However, when the displacer 20 is located at the bottom dead center, the collar upper end 70*b* comes into contact with the lower bumper 76, and communication between the lower section 72*b* and the upper section 72*a* through the second gap 78*b* is blocked. When the displacer 20 is located at the top dead center, the collar upper end 70*b* comes into contact with the upper bumper 74, and the communication between the lower section 72*b* and the upper section 72*a* through the second gap 78*b* is blocked. Therefore, when the displacer 20 is located at an intermediate position between the top dead center and the bottom dead center, the lower section 72*b* communicates with the room temperature chamber 36 through the upper section 72*a*, and the working gas can flow between the room temperature chamber 36 and the lower section 72*b*. In addition, the lower section 72*b* is sealed by the second seal portion 44. Accordingly, the lower section 72*b* does not communicate with the expansion chamber 34.

In addition, the cold head 14 includes a communication passage 80 that ensures the communication between the upper section 72*a* and the lower section 72*b* when the displacer 20 is located at the bottom dead center. The communication passage 80 is formed in the collar 70 so that the upper section 72*a* communicates with the lower section 72*b* in a state where the collar upper end 70*b* is in contact with the lower bumper 76. The communication passage 80 may be formed to penetrate the collar 70 (for example, the collar upper end 70*b*) from the upper section 72*a* to the lower section 72*b*, and at least one communication passage 80 may be in a circumferential direction. As illustrated, when the collar upper end 70*b* extends outward in the radial direction from the main body 70*a* of the collar 70, the communication passage 80 is formed in the collar upper end 70*b* at a position inside the lower bumper 76 in the radial direction. The communication passage 80 may be formed to penetrate the main body 70*a* of the collar 70.

The first gap 78*a*, the second gap 78*b*, and the communication passage 80 function as flow path resistance. Therefore, when the displacer 20 reciprocates, the upper section 72*a* and the lower section 72*b* can respectively generate a gas spring force. The displacer 20 moves upward, and the collar upper end 70*b* also moves upward so that the upper section 72*a* is narrowed. In this case, the gas of the upper section 72*a* is compressed, and the pressure increases. The pressure in the upper section 72*a* acts downward on the upper surface of the collar upper end 70*b*. Therefore, the upper section 72*a* generates a gas spring force acting against an upward movement of the collar 70 and the displacer 20. Similarly, when the displacer 20 moves downward, the lower section 72*b* generates a gas spring force acting against a downward movement of the collar 70 and the displacer 20. The upper section 72*a* and the lower section 72*b* may be respectively referred to as an upper gas spring chamber and a lower gas spring chamber. The gas spring force is helpful in reducing the vibration and the noise which are generated when the collar 70 comes into contact with the upper bumper 74 and the lower bumper 76.

An operation of the cryocooler 10 will be described. When the displacer 20 is located at or in the vicinity of the bottom dead center, an intake process of the cryocooler 10 starts. The main intake on-off valve V1 is opened, and the main exhaust on-off valve V2 is closed. The working gas is supplied from the compressor discharge port 12*a* to the displacer cylinder 26 of the cold head 14 through the main intake on-off valve V1, and the expansion chamber 34 and the room temperature chamber 36 have the high pressure PH. The exhaust process of the piston cylinder 28 is performed simultaneous with an intake process of the expansion chamber 34. The auxiliary intake on-off valve V3 is closed, and the auxiliary exhaust on-off valve V4 is opened. The working gas is discharged from the piston cylinder 28 to the compressor suction port 12*b* through the auxiliary exhaust on-off valve V4, and the piston cylinder 28 is decompressed to the low pressure PL.

Therefore, in the intake process, a driving force generated by a differential pressure (PH-PL) between the piston cylinder 28 and the expansion chamber 34 acts upward on the drive piston 22. As a result, the displacer 20 moves together with the drive piston 22 from the bottom dead center toward the top dead center. In this way, a volume of the expansion chamber 34 increases, and the expansion chamber 34 is filled with the high pressure gas.

The collar 70 also moves upward together with the displacer 20. The collar 70 comes into contact with the upper bumper 74 before the displacer 20 collides with a high temperature end portion (for example, the piston cylinder 28) of the displacer cylinder 26. The upper cushioning material 74*a* is compressed to absorb the impact. While the collar 70 moves upward, the upper section 72*a* communicates with the room temperature chamber 36 through the first gap 78*a*, and the lower section 72*b* communicates with the upper section 72*a* through the second gap 78*b* and the communication passage 80. Thereafter, the upper section 72*a* and the lower section 72*b* have the high pressure PH as in the room temperature chamber 36.

When the displacer 20 is located at or in the vicinity of the top dead center, the exhaust process of the cryocooler 10 starts. The main exhaust on-off valve V2 is opened, and the main intake on-off valve V1 is closed. The high pressure gas is expanded and cooled in the expansion chamber 34. The expanded gas is recovered to the compressor suction port 12*b* through the room temperature chamber 36 while cooling the regenerator 15. The expansion chamber 34 and the room temperature chamber 36 have the low pressure PL. The intake process of the piston cylinder 28 is performed simultaneous with the exhaust process of the expansion chamber 34. The auxiliary exhaust on-off valve V4 is closed, and the auxiliary intake on-off valve V3 is opened. The working gas is supplied from the compressor discharge port 12*a* to the piston cylinder 28 through the auxiliary intake on-off valve V3, and the piston cylinder 28 is pressurized to a high pressure PH.

Therefore, in the exhaust process, a driving force generated by the differential pressure (PH-PL) between the piston cylinder 28 and the expansion chamber 34 acts downward on the drive piston 22. Therefore, the displacer 20 moves together with the drive piston 22 from the top dead center toward the bottom dead center. In this way, the volume of the expansion chamber 34 decreases, and the low pressure gas is discharged.

The collar 70 moves downward together with the displacer 20. The collar 70 comes into contact with the lower bumper 76 before the displacer 20 collides with a low temperature end portion of the displacer cylinder 26. The lower cushioning material 76*a* is compressed to absorb the impact. While the collar 70 moves downward, the upper section 72*a* communicates with the room temperature chamber 36 through the first gap 78*a*, and the lower section 72*b* communicates with the upper section 72*a* through the second gap 78*b* and the communication passage 80. Thereafter, the upper section 72*a* and the lower section 72*b* have the low pressure PL as in the room temperature chamber 36.

The cryocooler 10 cools the cooling stage 38 by repeating a refrigeration cycle (that is, a GM cycle) in this way. In this manner, the cryocooler 10 can cool an object to be cooled (not illustrated) thermally coupled to the cooling stage 38.

The cryocooler 10 adopts the collar bumper type. Accordingly, it is possible to reduce the vibration and the noise by preventing the interference (for example, collision) between the displacer 20 and the displacer cylinder 26 which is caused by the contact between the collar 70 and the bumpers (74 and 76).

Incidentally, a gas-driven cryocooler adopting a typical collar bumper type does not have the communication passage 80, unlike the above-described embodiment. In this case, when the collar 70 is located at the bottom dead center, the working gas having the low pressure PL may be sealed in the lower section 72*b*. In this state, if the upper section 72*a* is pressurized to the high pressure PH when the intake process starts, the collar upper end 70*b* may be pressed against the lower bumper 76 due to the differential pressure (PH-PL). This differential pressure power may hinder the upward movement of the displacer 20.

However, the cryocooler 10 according to the embodiment includes the communication passage 80 formed in the collar 70 to ensure the communication between the upper section 72*a* and the lower section 72*b* when the displacer 20 is located at the bottom dead center. Therefore, even when the collar 70 is located at the bottom dead center and the collar upper end 70*b* is in contact with the lower bumper 76, the lower section 72*b* communicates with the upper section 72*a* through the communication passage 80. The lower section 72*b* is not sealed. The differential pressure that may be generated between the upper section 72*a* and the lower section 72*b* is reduced or eliminated through the communication passage 80. Accordingly, the upward movement of the displacer 20 is not hindered. Therefore, the displacer 20 can move from the bottom dead center toward the top dead center.

The communication passage 80 is formed in the collar 70. In this case, it is easy to form the communication passage 80 in terms of manufacturing.

Figure 3:
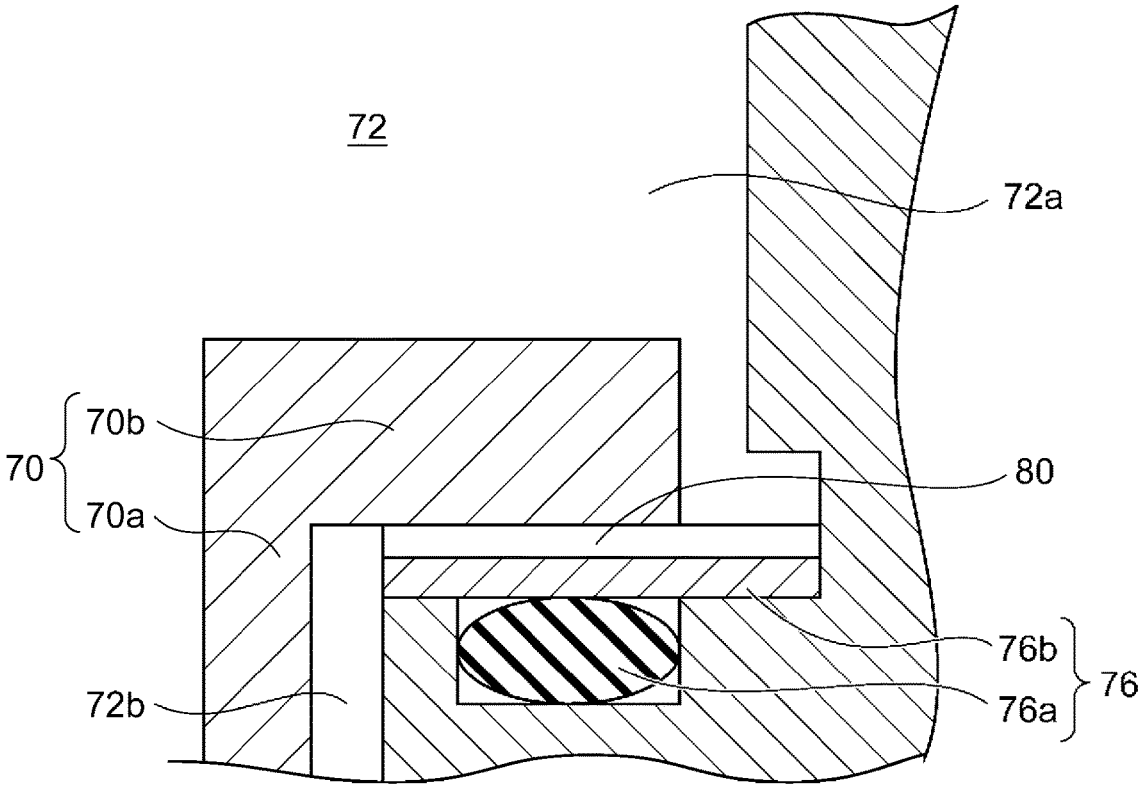
FIG. 3 is a view schematically illustrating a collar and a bumper according to another embodiment.

FIG. 3 is a view schematically illustrating a collar and a bumper according to another embodiment. As illustrated, the communication passage 80 may be formed in the collar chamber 72 without being formed in the main body 70*a* of the collar 70 or the collar upper end 70*b*. For example, the communication passage 80 may be formed in the lower bumper 76. For example, the communication passage 80 may be a groove formed on the upper surface of the lower retainer 76*b* on a side opposite to the lower cushioning material 76*a*. The communication passage 80 formed in the collar chamber 72 illustrated in FIG. 3 is applicable to the cryocooler 10 illustrated in FIGS. 1 and 2 or other gas-driven cryocoolers adopting the collar bumper type.

Even in this case, the communication passage 80 can ensure the communication between the upper section 72*a* and the lower section 72*b* when the displacer 20 is located at the bottom dead center. The differential pressure that may be generated between the upper section 72*a* and the lower section 72*b* is reduced or eliminated through the communication passage 80. Accordingly, it is possible to facilitate the movement of the displacer 20 from the bottom dead center toward the top dead center.

In another example in which the communication passage 80 is formed in the collar chamber 72, the communication passage 80 may be a flow path formed in the cold head housing 18. For example, the communication passage 80 may extend from the upper section 72*a* to the lower section 72*b* by way of the sleeve 73 and the cylinder flange 26*a*. Even in this case, the communication passage 80 can ensure the communication between the upper section 72*a* and the lower section 72*b* when the displacer 20 is located at the bottom dead center.

Hitherto, the present invention has been described based on the embodiments. The present invention is not limited to the above-described embodiments. It may be understood by those skilled in the art that various design changes can be made, various modification examples can be adopted, and the modification examples also fall within the scope of the present invention. Various features described with regard to a certain embodiment are also applicable to other embodiments. A new embodiment acquired from the combination compatibly achieves respective advantageous effects of the combined embodiments.

In the above-described embodiment, the collar upper end 70*b* is provided outside the displacer 20 in the radial direction. However, this specific shape is not essential. For example, the collar upper end 70*b* may extend inward in the radial direction from the main body 70*a*, and may exist inside the outer diameter of the displacer 20. In this case, the collar chamber 72 is formed on the piston cylinder 28 side without being formed on the sleeve 73 side as described above.

In the above-described embodiment, the upper bumper 74 is attached to the upper surface of the collar chamber 72 and is disposed in the upper section 72*a*. The lower bumper 76 is attached to the lower surface of the collar chamber 72, and is disposed in the lower section 72*b*. However, the upper bumper 74 and the lower bumper 76 may be attached to the collar 70. For example, the upper bumper 74 may be attached to the upper surface of the collar upper end 70*b*, and may be disposed in the upper section 72*a*. The lower bumper 76 may be attached to the lower surface of the collar upper end 70*b*, and may be disposed in the lower section 72*b*. Even in this way, it is possible to reduce the vibration and the noise by preventing the interference (for example, collision) between the displacer 20 and the displacer cylinder 26 which is caused by the contact between the collar chamber 72 and the bumpers (74 and 76).

In the above-described embodiments, the GM cryocooler has been described as an example. However, the above-described design of the collar bumper type having the communication passage 80 is also applicable to other gas-driven cryocoolers. In that case, the terms "displacer" and "drive piston" in the above description may respectively mean a "first piston" and a "second piston".

The present invention can be used in a field of cryocoolers.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

a cylinder;

a displacer disposed inside the cylinder and driven to reciprocate by a gas pressure;

a collar rigidly connected to the displacer to reciprocate together with the displacer;

a collar chamber divided into an upper section and a lower section by the collar;

a seal portion provided between the displacer and the cylinder to seal the lower section;

a lower bumper provided in the lower section to mitigate interference between the displacer and the cylinder when the displacer is located at a bottom dead center; and a communication passage formed in the collar or in the collar chamber to ensure communication between the upper section and the lower section when the displacer is located at the bottom dead center, wherein the displacer forms an expansion chamber with the cylinder at an axial end thereof, and forms a room temperature chamber with the cylinder at an opposite axial end thereof, a first gap is radially inwardly adjacent to an inner peripheral surface of the collar, and a second gap is radially outwardly adjacent to an outer peripheral surface of the collar, the upper section of the collar chamber communicates with the room temperature chamber through the first gap, the lower section of the collar chamber communicates with the room temperature chamber through the first gap, the upper section, and the second gap, and the communication between the lower section and the upper section through the second gap is blocked when the displacer is located at the bottom dead center.

2. The cryocooler according to claim 1, wherein the communication passage is formed in the collar.

3. The cryocooler according to claim 2, wherein the collar includes a cylindrical main body extending upward from the displacer in an axial direction of the displacer, and a collar upper end extending radially from the main body, and the communication passage penetrates the collar upper end in the axial direction of the displacer.

4. The cryocooler according to claim 1, further comprising:

a cold head housing including the cylinder; and an upper bumper provided in the upper section to mitigate interference between the displacer and the cold head housing when the displacer is located at a top dead center.

5. The cryocooler according to claim 1, wherein the upper section of the collar chamber functions as an upper gas spring chamber, and the lower section of the collar chamber functions as a lower gas spring chamber.

6. The cryocooler according to claim 1, further comprising:

a valve portion that controls the gas pressure that causes the displacer to reciprocate; and a drive source that drives the valve portion, wherein the displacer and the collar are not mechanically connected to the drive source.

7. The cryocooler according to claim 1, wherein the cryocooler is a gas-driven GM cryocooler.

8. A cryocooler comprising a cylinder;

a displacer disposed inside the cylinder and driven to reciprocate by a gas pressure;

a collar rigidly connected to the displacer to reciprocate together with the displacer;

a collar chamber divided into an upper section and a lower section by the collar;

a seal portion provided between the displacer and the cylinder to seal the lower section;

a lower bumper provided in the lower section to mitigate interference between the displacer and the cylinder when the displacer is located at a bottom dead center; and a communication passage formed in the collar or in the collar chamber to ensure communication between the upper section and the lower section when the displacer is located at the bottom dead center, wherein the communication passage is formed in the lower bumper.

9. The cryocooler according to claim 8, wherein the lower bumper includes a lower cushioning material and a lower retainer which are installed on a lower surface of the collar chamber, and the communication passage includes a groove formed on an upper surface of the lower retainer located on a side opposite to the lower cushioning material.

* * * * *